US009839297B2

(12) United States Patent
Lawson et al.

(10) Patent No.: US 9,839,297 B2
(45) Date of Patent: Dec. 12, 2017

(54) SPLIT OTTOMAN LINKAGE ACCOMODATING A CHAISE PAD

(71) Applicant: L&P PROPERTY MANAGEMENT COMPANY, South Gate, CA (US)

(72) Inventors: Gregory Mark Lawson, Tupelo, MS (US); Jason Allan Bryant, Fulton, MS (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 14/670,188

(22) Filed: Mar. 26, 2015

(65) Prior Publication Data

US 2015/0272335 A1 Oct. 1, 2015

Related U.S. Application Data

(60) Provisional application No. 61/971,853, filed on Mar. 28, 2014.

(51) Int. Cl.
*A47C 7/50* (2006.01)
*A47C 1/024* (2006.01)

(52) U.S. Cl.
CPC ..... *A47C 7/506* (2013.01); *A47C 1/024* (2013.01); *A47C 7/503* (2013.01)

(58) Field of Classification Search
CPC ..... A47C 7/506; A47C 1/024; A47C 7/503
See application file for complete search history.

(56) References Cited

U.S. PATENT DOCUMENTS 5,087,094 A 2/1992 Rogers, Jr.
5,354,116 A * 10/1994 May ..... A47C 1/0355 297/423.34
5,419,611 A * 5/1995 Cook ..... A47C 1/0355 297/75
5,547,245 A 8/1996 Knouse
5,704,686 A 1/1998 May
5,800,010 A 9/1998 May
6,540,291 B2 * 4/2003 Hoffman ..... A47C 1/03255 297/84
7,762,625 B2 * 7/2010 Hoffman ..... A47C 1/0355 297/423.26
2003/0227197 A1 12/2003 Tacker
2012/0119547 A1 5/2012 Hoffman et al.
2013/0200659 A1 8/2013 Hoffman et al.

OTHER PUBLICATIONS

International Search Report with Written Opinion dated Jun. 26, 2015 in Application No. PCT/US2015/022989, 8 pages.
International Preliminary Report on Patentability dated Oct. 13, 2016 for International Patent Application No. PCT/US2015/022989, 7 pages.
European Search Report dated Sep. 18, 2017 in European Patent Application No. 15768982.9, 7 pages.

* cited by examiner

*Primary Examiner* — Charles A Fox
*Assistant Examiner* — Christopher E Veraa
(74) *Attorney, Agent, or Firm* — Shook, Hardy & Bacon L.L.P.

(57) ABSTRACT

A split ottoman linkage having a plurality of interconnected links that move a middle ottoman and a front ottoman from a closed position to an extended position. The middle ottoman moves in a relatively constant radial arc, such that a chaise pad can be used on the chair. The middle ottoman and the front ottoman are positioned adjacent one another in the closed position, and are spaced from one another in the extended position.

19 Claims, 10 Drawing Sheets

SPLIT OTTOMAN LINKAGE ACCOMODATING A CHAISE PAD

CROSS-REFERENCE TO RELATED APPLICATIONS

This Application claims priority to U.S. Provisional Application Ser. No. 61/971,853, filed Mar. 28, 2014, herein incorporated by reference in its entirety.

STATEMENT REGARDING FEDERALLY SPONSORED RESEARCH OR DEVELOPMENT

Not applicable.

TECHNICAL FIELD

Aspects of this disclosure relate to chair reclining mechanisms. More particularly, this disclosure includes embodiments relating to an extendable ottoman linkage having a split pad configuration usable with a chair having a chaise pad.

BACKGROUND

Chairs now sometimes have what is known as a "chaise pad." In this construction, a pad extends from the seat and along the front of the chair, forming part of the footrest, when the chair is in the closed position. When the footrest is extended, the chaise pad forms a continuous pad from the seat and extends outwardly from the seat. It is also desirable to have an additional foot support that extends beyond the chaise pad. The challenge is that, because the chaise pad is a continuous piece, the support portion of the footrest linkage supporting the chaise pad must extend the same distance from the seat in both the closed and extended positions. What is needed is a split ottoman that allows the chaise pad support, but that also provides a more-forward footrest section that abuts the chaise pad in the closed position, but that extends farther away from the chaise pad in the extended position.

BRIEF SUMMARY

The present disclosure generally relates to a split ottoman linkage having a plurality of interconnected links that move a middle ottoman and a front ottoman from a closed position to an extended position. The middle ottoman moves in a relatively constant radial arc, such that a chaise pad can be used on the chair. The middle ottoman and the front ottoman are positioned adjacent one another in the closed position, and are spaced from one another in the extended position.

Accordingly, in one embodiment, a split ottoman linkage for a reclining chair mechanism on a chair having a frame, a seat, and a backrest is provided. The split ottoman linkage includes a front ottoman link having first and second ends, the first end is coupled to an upper ottoman link of a reclining chair mechanism. The split ottoman linkage also includes a middle ottoman link having first and second ends, the first end being coupled to a lower ottoman link of the reclining chair mechanism and the middle ottoman link is coupled to the upper ottoman link near the first end. The split ottoman linkage further includes a bridge link coupled to the second end of the middle ottoman link and near the second end of the front ottoman link, the middle ottoman link and bridge link are adapted to extend the bridge link in a relatively constant radial arc. Additionally, the split ottoman linkage includes a front ottoman bracket coupled to the second end of the front ottoman link; and a coupling link coupled between the bridge link and the front ottoman bracket. The split ottoman linkage is adapted to move between a closed position with the bridge link and the front ottoman bracket positioned close to one another, and an extended position where the bridge link and the front ottoman bracket are spaced from one another.

In another embodiment, a split ottoman linkage for a reclining chair mechanism on a chair having a frame, a seat, and a backrest is provided. The split ottoman linkage includes a front ottoman link having first and second ends, the first end being coupled to an upper ottoman link of a reclining chair mechanism. The split ottoman linkage also includes a middle ottoman link having first and second ends, the first end being coupled to a lower ottoman link of the reclining chair mechanism. The middle ottoman link is coupled to the upper ottoman link at an upper ottoman link connection point that is closer to the first end than the second end of the middle ottoman link. Additionally, the split ottoman linkage includes a bridge link coupled to the second end of the middle ottoman link, the bridge link being coupled to the front ottoman link at a bridge link connection point that is closer to the second end than the first end of the front ottoman link. The middle ottoman link and the bridge link are adapted to extend the bridge link in a relatively constant radial arc when the split ottoman linkage is shifted between a closed position and an extended position. The split ottoman linkage further includes a front ottoman bracket having first and second ends, the first end being coupled to the second end of the front ottoman link at a front ottoman bracket connection point. When the split ottoman linkage is shifted between the closed position and the extended position, the bridge link connection point maintains a fixed position along the bridge link and the front ottoman bracket connection point maintains a fixed position along the front ottoman bracket.

In yet another embodiment, a chair having a reclining mechanism is provided. The chair includes a frame, a seat pad, a seat back, and a split ottoman linkage adapted for use with a reclining mechanism. The split ottoman linkage includes a front ottoman link having first and second ends, the first end is coupled to an upper ottoman link of a reclining chair mechanism. The split ottoman linkage also includes a middle ottoman link having first and second ends, the first end being coupled to a lower ottoman link of the reclining chair mechanism and the middle ottoman link is coupled to the upper ottoman link near the first end. The split ottoman linkage further includes a bridge link coupled to the second end of the middle ottoman link and near the second end of the front ottoman link, the middle ottoman link and bridge link are adapted to extend the bridge link in a relatively constant radial arc. Additionally, the split ottoman linkage includes a front ottoman bracket coupled to the second end of the front ottoman link; and a coupling link coupled between the bridge link and the front ottoman bracket. The split ottoman linkage is adapted to move between a closed position with the bridge link and the front ottoman bracket positioned close to one another, and an extended position where the bridge link and the front ottoman bracket are spaced from one another.

Additional objects, advantages, and novel features of the invention will be set forth in part in the description that follows, and in part will become apparent to those skilled in the art upon examination of the following, or may be learned by practice of the invention.

BRIEF DESCRIPTION OF SEVERAL VIEWS OF THE DRAWINGS

The present invention is described in detail below with reference to the attached drawing figures, wherein.

DETAILED DESCRIPTION

The subject matter of certain aspects is described with specificity herein to meet statutory requirements. However, the description itself is not intended to limit the scope of this patent. Rather, the inventors have contemplated that the claimed subject matter might also be embodied in other ways, to include different elements or combinations of elements similar to the ones described in this document, in conjunction with other present or future technologies.

Figure 1A:
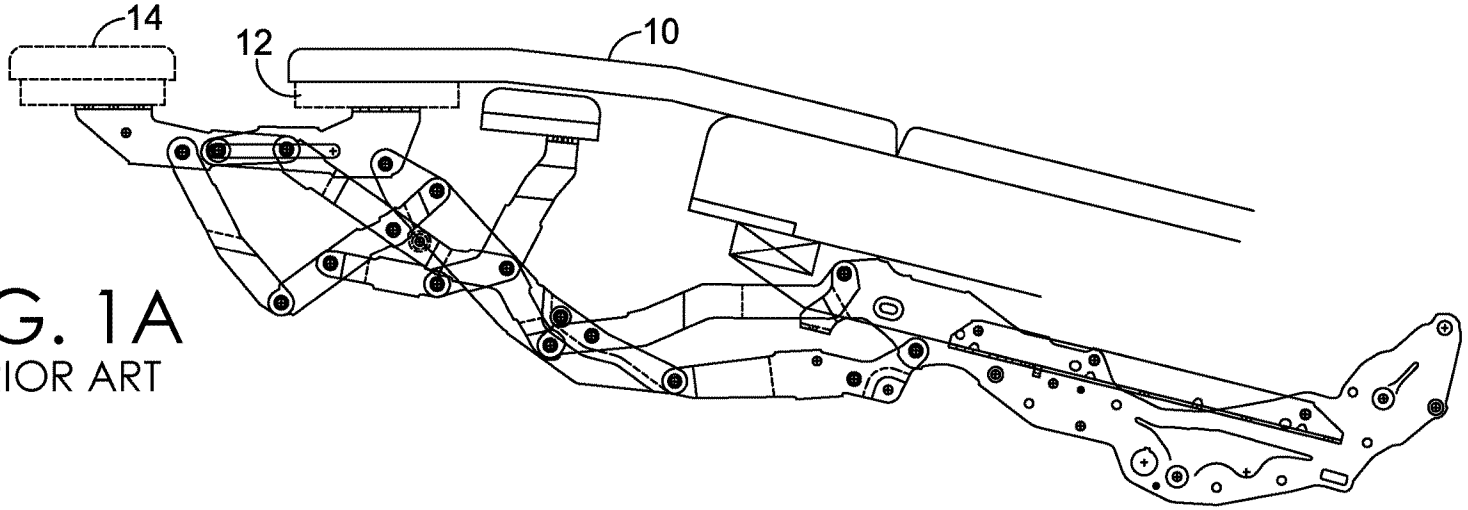
FIG. 1A PRIOR ART
FIG. 1A is an exemplary prior art ottoman linkage showing a slotted link with the ottoman linkage in the open position.
Figure 1B:
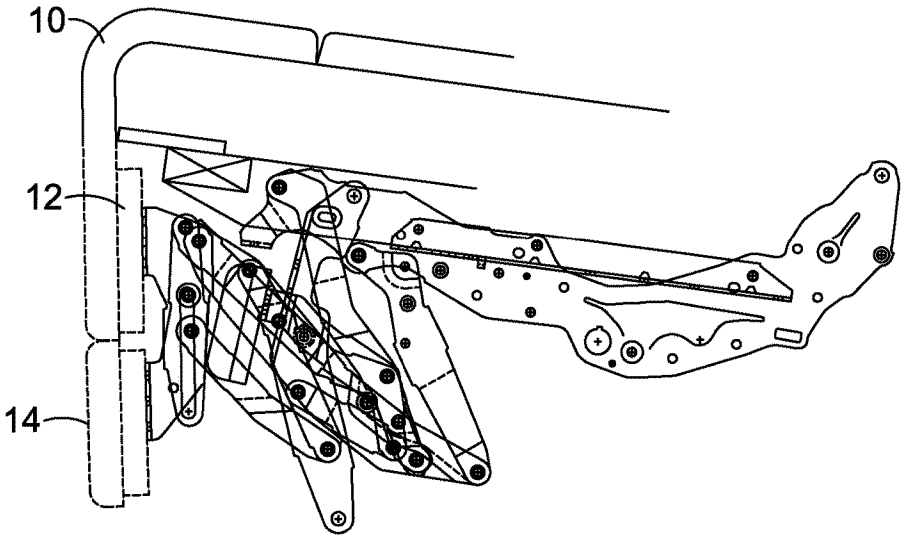
FIG. 1B PRIOR ART
FIG. 1B is an exemplary prior art ottoman linkage showing a slotted link with the ottoman linkage in the closed position.

FIGS. 1A and 1B depict the prior art front section of a chair with a split ottoman in an open and a closed position, respectively. The chair is illustrated with a chaise pad 10 that extends over the front edge of the chair seat, and extends downwardly in the closed position (FIG. 1B). In the open position, the chaise pad extends outwardly from the chair seat, forming a continuous surface (FIG. 1A). The forward area of the chaise pad is coupled to an ottoman support section 12. This support section must extend from the closed position to the open position such that the chaise pad will not be pulled off of the ottoman support section. Additionally, it is desirable to have an additional ottoman support section, such as the front section 14. This front section extends directly below the ottoman support section 12, and abuts this ottoman support section 12, when in the closed position, as shown in FIG. 1B. In the open position, as shown in FIG. 1A, the front section 14 extends outwardly and is separated from the section 12. In the prior art, this functionality was accomplished with a slotted link, as can be seen in FIGS. 1A and 1B. The drawback to using a slotted link is that the mechanism is relatively complicated, and is prone to malfunction if not positioned exactly as required.

Figure 2:
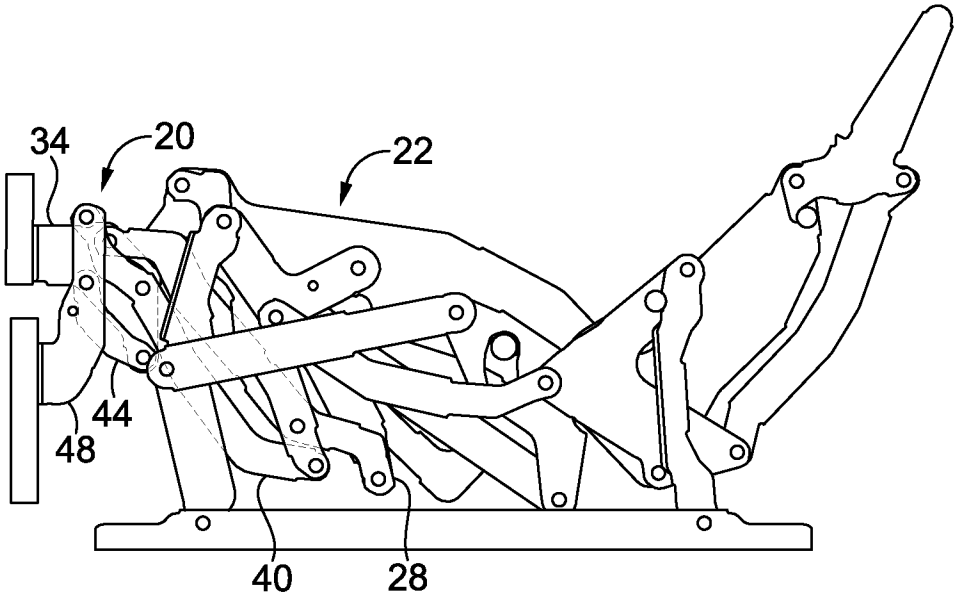
FIG. 2 is a side view of an exemplary chair with a split ottoman linkage in the closed position.
Figure 3:
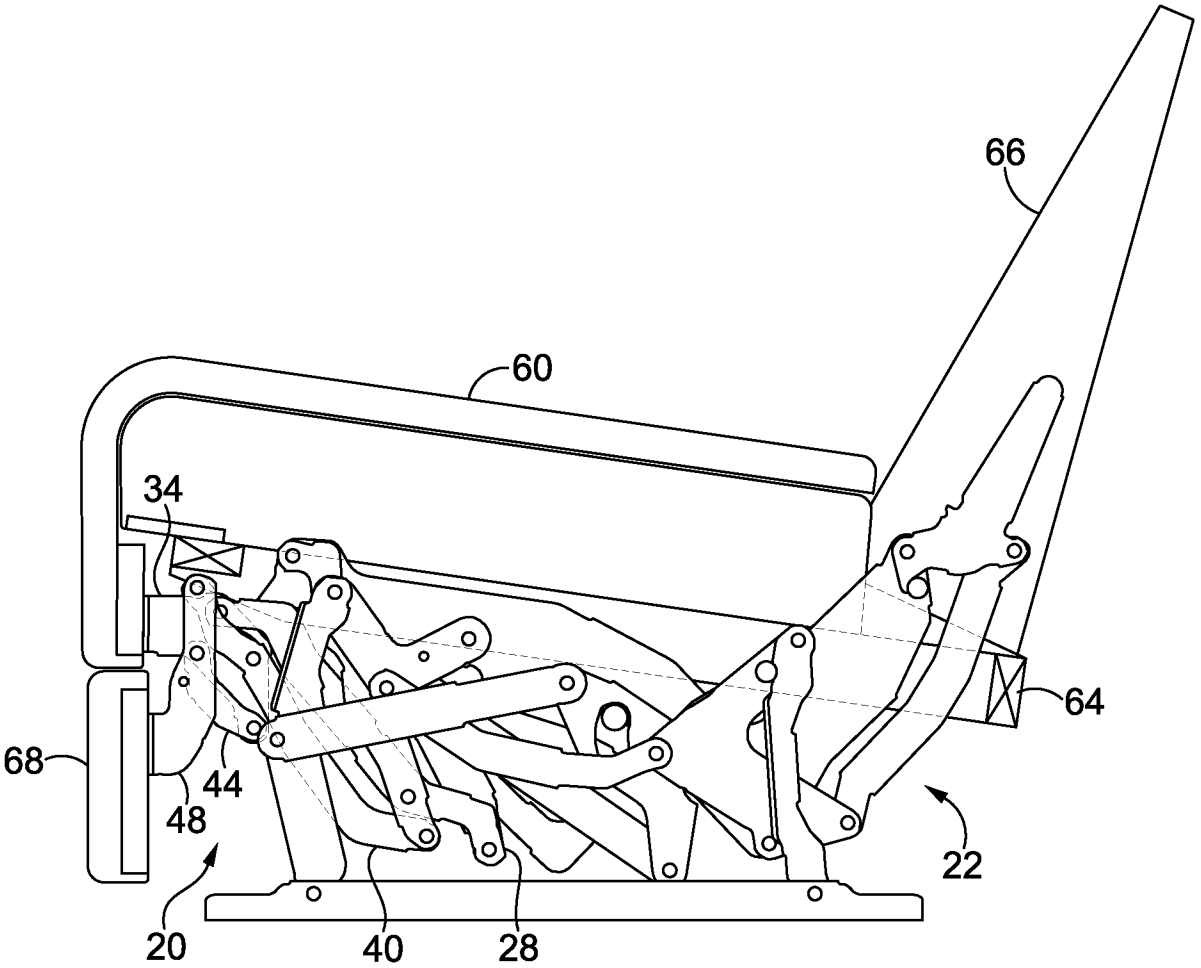
FIG. 3 is a schematic view similar to FIG. 2, but showing the use and positioning of a chaise pad.

FIGS. 2 and 3 depict a chair with a split ottoman linkage 20 positioned on a reclining mechanism 22. The split ottoman linkage 20 is depicted in the closed position. FIG. 2 depicts the split ottoman linkage 20 and the reclining mechanism 22 in the absence of a chair frame and a seat pad, while FIG. 3 is a schematic view that reveals the position of at least a portion of the frame 64, chaise pad 60, front pad 68, and seat back 66 relative to the split ottoman linkage 20 and the reclining mechanism 22. It should be understood that the schematic view of FIG. 3 has various chair parts removed and/or has other parts superimposed on other elements in order to highlight relevant features of split ottoman linkage 20 and reclining mechanism 22. While shown in use on a particular reclining mechanism 22, it should be understood that the ottoman linkage 20 is adapted to be usable on virtually any reclining mechanism configuration with only minimal alteration. An exemplary reclining mechanism on which the ottoman linkage 20 could be used is described in U.S. patent application Ser. No. 14/064,700, which was filed on Oct. 28, 2013, the disclosure of which is hereby incorporated by reference in its entirety.

Figure 4:
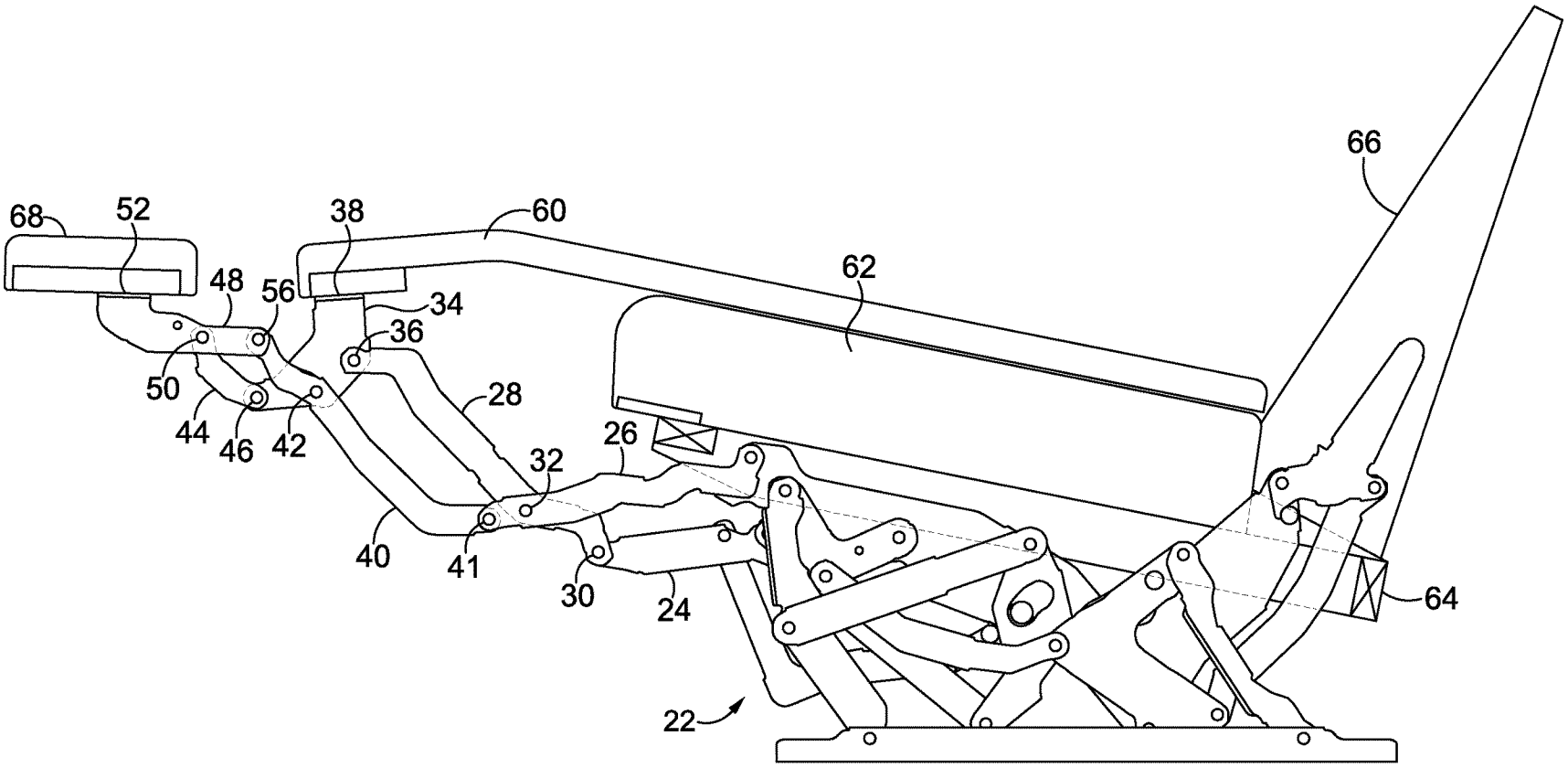
FIG. 4 is a schematic view similar to FIG. 3 but showing the open, TV position.
Figure 5:
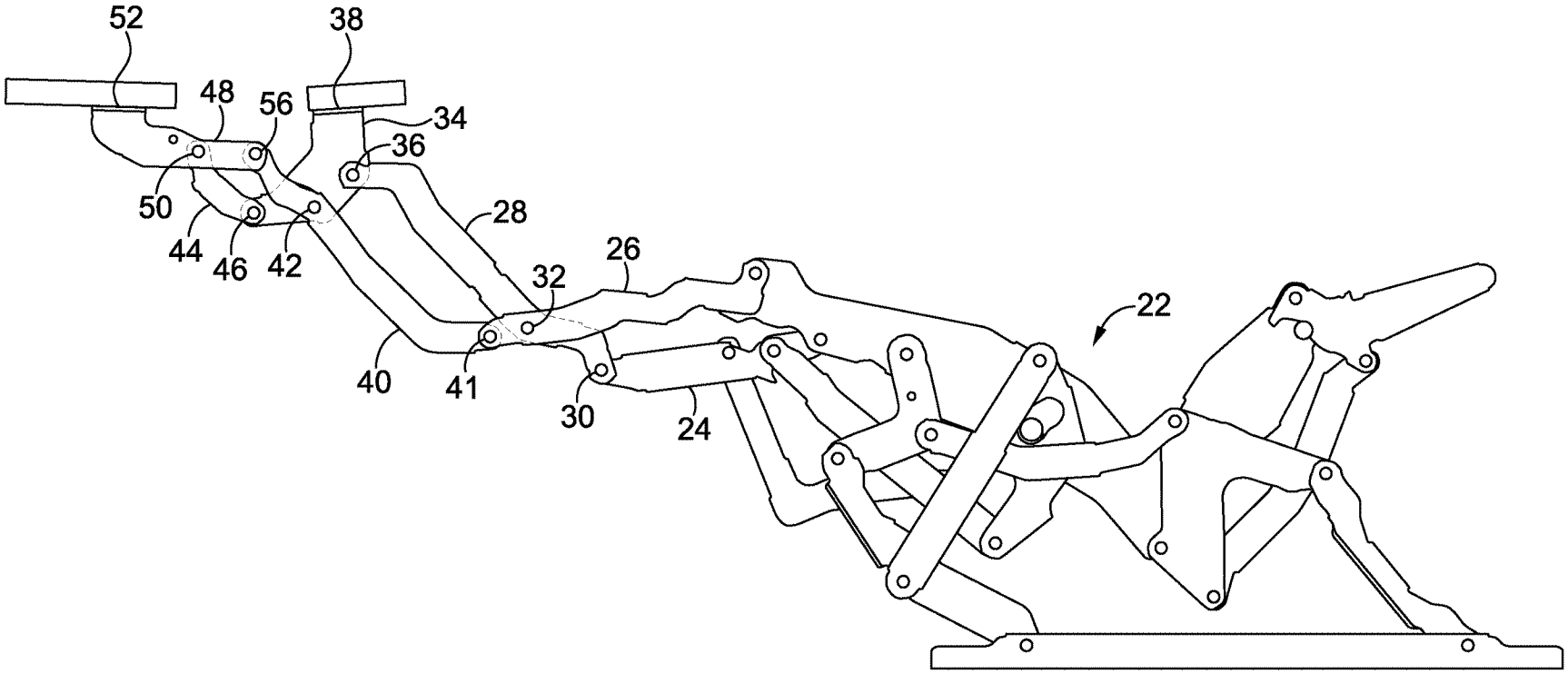
FIG. 5 is a view similar to FIG. 4, showing the fully reclined position, without the seat and chaise pad.

Ottoman linkage 20 includes a series of interconnected links that control the extension and retraction of the ottoman from the closed position depicted in FIGS. 2 and 3, to the open position depicted in FIGS. 4 and 5. It should be understood that while only one split ottoman linkage 20 is described and depicted in the figures, a pair of split ottoman linkages can be present on a chair, with each essentially being a mirror image of the other and disposed in opposing-facing relation about a longitudinally-extending plane that bisects the chair. As such, the ensuing discussion will focus on only one of the split ottoman linkages, e.g., split ottoman linkage 20, with the content being equally applied to the other complimentary split ottoman linkage assembly.

It should be understood and appreciated that the components of split ottoman linkage 20 discussed herein may be formed from any suitable material known in the furniture-manufacturing industry, such as metal stock (e.g., stamped, formed steel) for brackets, plates, and links. Further, it should be understood and appreciated that the components may be connected together using any techniques or mechanisms known in the furniture-manufacturing industry. For example, components that are rigidly connected may be connected via rivets, bolts, welding, etc. In addition, the shapes of the components described herein may vary, as well as any connection or attachment points between components.

As best seen in FIG. 4, the ottoman linkage 20 is coupled to reclining mechanism 22 via a lower ottoman link 24 and an upper ottoman link 26. It should be understood that the schematic view of FIG. 4 has various chair parts removed and/or has other parts superimposed on other elements in order to highlight relevant features of split ottoman linkage 20 and reclining mechanism 22. Lower ottoman link 24 and upper ottoman link 26 exist in one form or another on various existing reclining mechanisms, such as reclining mechanism 22. Ottoman linkage 20 is coupled to lower ottoman link 24 through the pivotable coupling of a middle ottoman link 28 at connection point 30. Middle ottoman link 28 is also pivotably coupled to upper ottoman link 26 at connection point 32, i.e., ottoman drive connection point 32. At the end of middle ottoman link 28 opposite from connection point 30, middle ottoman link 28 is pivotably coupled to a bridge link 34 at connection point 36, i.e., middle ottoman link connection point 36. Bridge link 34 has an upper end terminating in a horizontally extending chaise pad attachment platform 38. Bridge link 34 has a shallow C shape, and is pivotably connected to a front ottoman link 40 at a connection point 42, i.e., bridge link connection point 42, below connection point 36 (as viewed in FIG. 4). The lower end of front ottoman link 40 is pivotably coupled to upper ottoman link 26 at connection point 41. The end of bridge link 34 opposite horizontally extending chaise pad attachment platform 38 is pivotably coupled to a coupling link 44 at a connection point 46, i.e., coupling link connection point 46. Coupling link 44 operates to couple the bridge link 34 to a front ottoman bracket 48 through a pivotal coupling 50. The front ottoman bracket 48 has an upper end terminating in a horizontally extending front ottoman pad attachment platform 52. Platform 52 is used as an attachment and support surface for a front ottoman pad 68. The end of front ottoman bracket 48 opposite pad 68 is pivotably coupled to front ottoman link 40 at connection point 56, i.e., front ottoman bracket connection point 56.

It is understood and appreciated that the pivotable couplings between the linkages described above and elsewhere herein can take a variety of configurations, such as pivot pins, bearings, traditional mounting hardware, rivets, bolt and nut combinations, or any other suitable fasteners which are well-known in the furniture-manufacturing industry. Further, the shapes of the linkages and the brackets may vary, as may the locations of certain pivot and/or connection points. It will be understood that when a linkage is referred to as being pivotably "coupled" to, "connected" to, "interconnected" with, "attached" on, etc., another element (e.g., linkage, bracket, frame, and the like), it is contemplated that the linkage and elements may be in direct contact with each other, or other elements, such as intervening elements, may also be present.

As shown in FIGS. 3 and 4, the chair used with ottoman linkage 20 may have a chaise pad 60. The front of chaise pad 60 can be connected to the horizontally extending chaise pad attachment platform 38. The chaise pad 60 can be connected to the horizontally extending chaise pad attachment platform 38 in any manner known to one skilled in the art, such as with staples, adhesive, and the like. As the ottoman linkage 20 extends from the closed position shown in FIG. 3 to the open position shown in FIG. 4, the front of the chaise pad 60 moves from a somewhat vertical position depicted in FIG. 3 to the horizontal position depicted in FIG. 4. As the ottoman linkage 20 extends, the links cooperate to maintain a relatively constant radial arc for the horizontally extending chaise pad attachment platform 38, such that the front of chaise pad 60 is supported at a relatively constant distance with respect to a seat cushion 62. This enables the chaise pad 60 to extend, and be supported, without being pulled away from seat cushion 62. Additionally, as ottoman linkage 20 extends, the front ottoman pad 68 moves from a position as shown in FIG. 3 directly adjacent and abutting the front of chaise pad 60, to an extended position away from the front of chaise pad 60 as shown in FIG. 4.

The ottoman linkage 20 can shift from a closed to an extended position by initiating movement of upper ottoman link 26 and lower ottoman link 24 from the vertical position depicted in FIG. 3 to the horizontal position depicted in FIG. 4. One can initiate this movement with the use of standard mechanisms known in the art, such as via a lever. As upper ottoman link 26 and lower ottoman link 24 move from a vertical position to a horizontal position, middle ottoman link 28 and front ottoman link 40 move away from seat cushion 62 and upward, rotating about connection points 30 and 41, respectively. As middle ottoman link 28 and front ottoman link 40 move away from seat cushion 62 and upward, bridge link 34 rotates from the vertical position depicted in FIG. 3 to the horizontal position depicted in FIG. 4 at least partly by rotating about connection point 36. As bridge link 34 rotates and moves, coupling link 44 and front ottoman bracket 48 are urged forward and upward through a force applied at least partly to connection points 50 and 46. As bridge link 34 extends to the horizontal position depicted in FIG. 4, front ottoman link 40 continues to apply a force to front ottoman bracket 48 at least at connection point 56 causing front ottoman bracket 48 to rotate about connection point 50 and extend outward until coupling link 44 and front ottoman link 40 restrict any further outward movement of front ottoman bracket 48.

One can retract the split ottoman linkage 20, e.g., shift from an extended position to a closed position, by initiating movement of upper ottoman link 26 and lower ottoman link 24 from the horizontal position depicted in FIG. 4 to the vertical position depicted in FIG. 3. One skilled in the art would understand and appreciate that this retracting movement of upper ottoman link 26 and lower ottoman link 24 causes the components of split ottoman linkage 20 to move in a direction opposite that of the movements for the extension of the split ottoman linkage 20 described immediately above.

The reclining mechanism may be configured to create varying amounts of separation between the front ottoman pad 68 and the chaise pad 60. In one example, the illustrated mechanism, when in the extended position, creates about 2.5 inches of separation between the front ottoman pad 68 and the front of the chaise pad 60. This extended position is accomplished with a simple linkage that can be used on a variety of reclining chair mechanisms. As shown in FIG. 5, the reclining mechanism 22 may be moved to a fully-reclined position as well.

Figure 6:
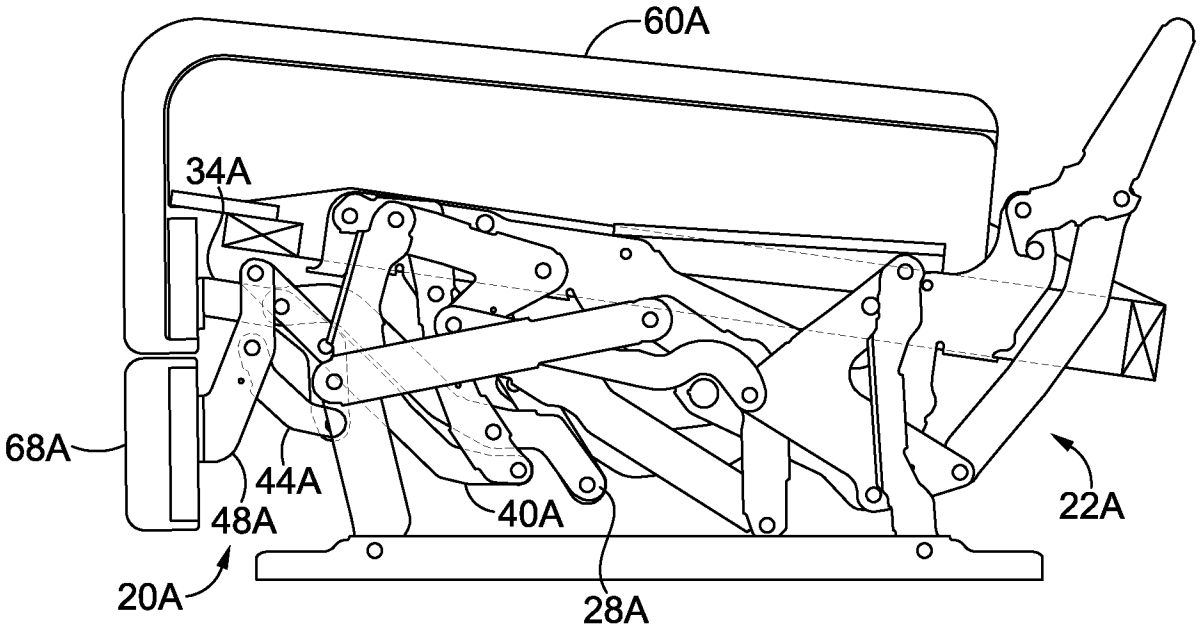
FIG. 6 is a schematic view of an alternative split ottoman linkage in use on a low-profile style chair mechanism, in the closed position.
Figure 7:
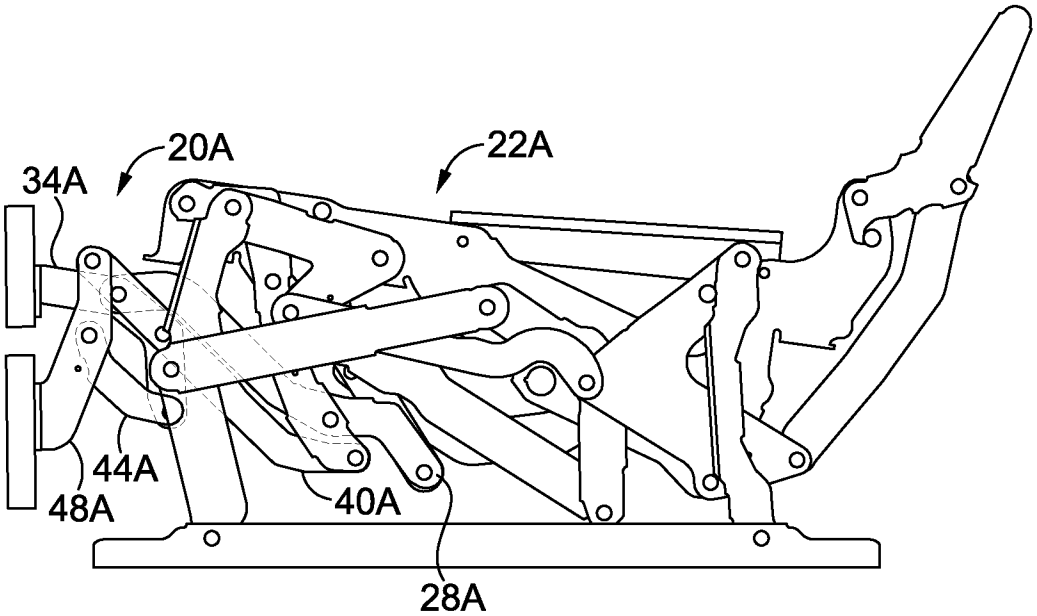
FIG. 7 is a view similar to FIG. 6, with the seat and chaise pad removed.
Figure 8:
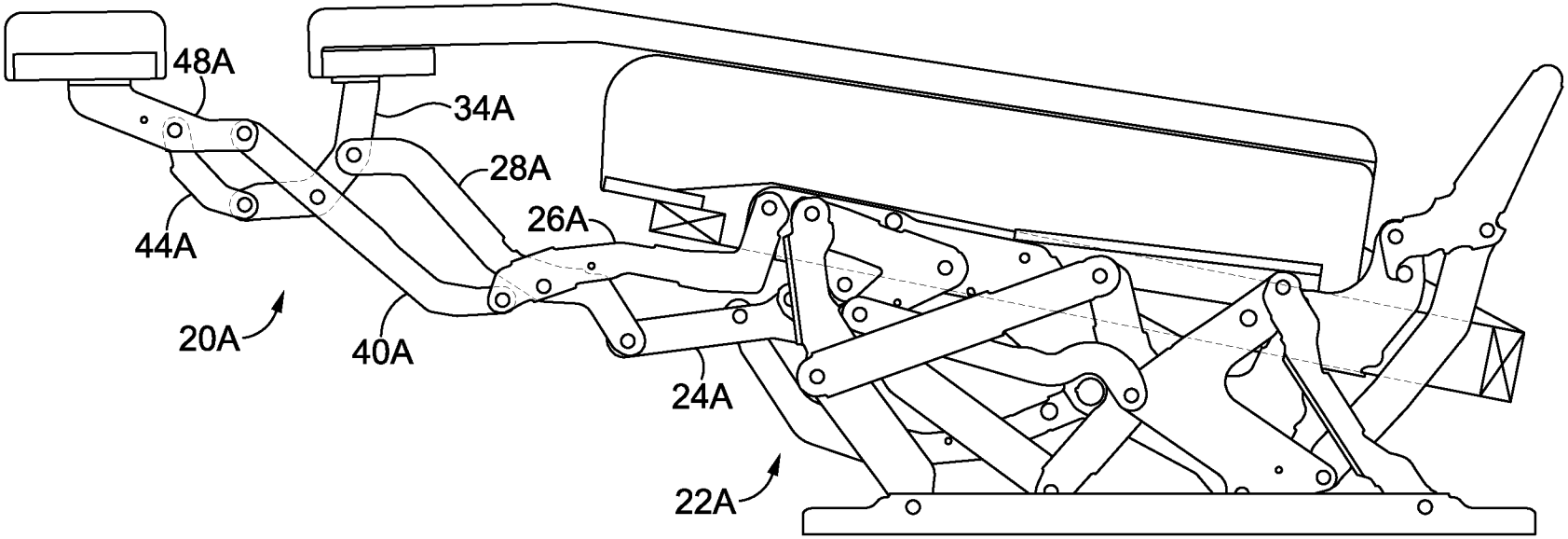
FIG. 8 is a schematic view similar to FIG. 6, shown in the open, TV position.

As another example, depicted in FIGS. 6-10, a similar split ottoman linkage 20A is shown on a reclining mechanism 22A having a configuration that is more low-profile. The low-profile reclining mechanism 22A allows for certain alternative chair styles, such as low-to-the-floor chair types. As best seen in FIG. 8, the links of the ottoman linkage 20A are connected to a lower ottoman link 24A and an upper ottoman link 26A. The links of ottoman linkage 20A include a middle ottoman link 28A, a front ottoman link 40A, a bridge link 34A, a coupling link 44A, and a front ottoman bracket 48A. These links are coupled to one another in a similar fashion to the links of ottoman linkage 20 described above, and so will not be detailed further here. Importantly, the ottoman linkage 20A is configured largely the same, with only slightly different geometry necessitated by the lower profile reclining mechanism 22A. For example, one or more of middle ottoman link 28A and front ottoman link 40A can have mirror size and/or shape changes compared to middle ottoman link 28 and front ottoman link 40, respectively, which can be necessitated by the physical constraints provided with low profile reclining mechanism 22A. One skilled in the art would understand any required slight geometric differences necessitated by the low profile reclining mechanism 22A.

Figure 9:
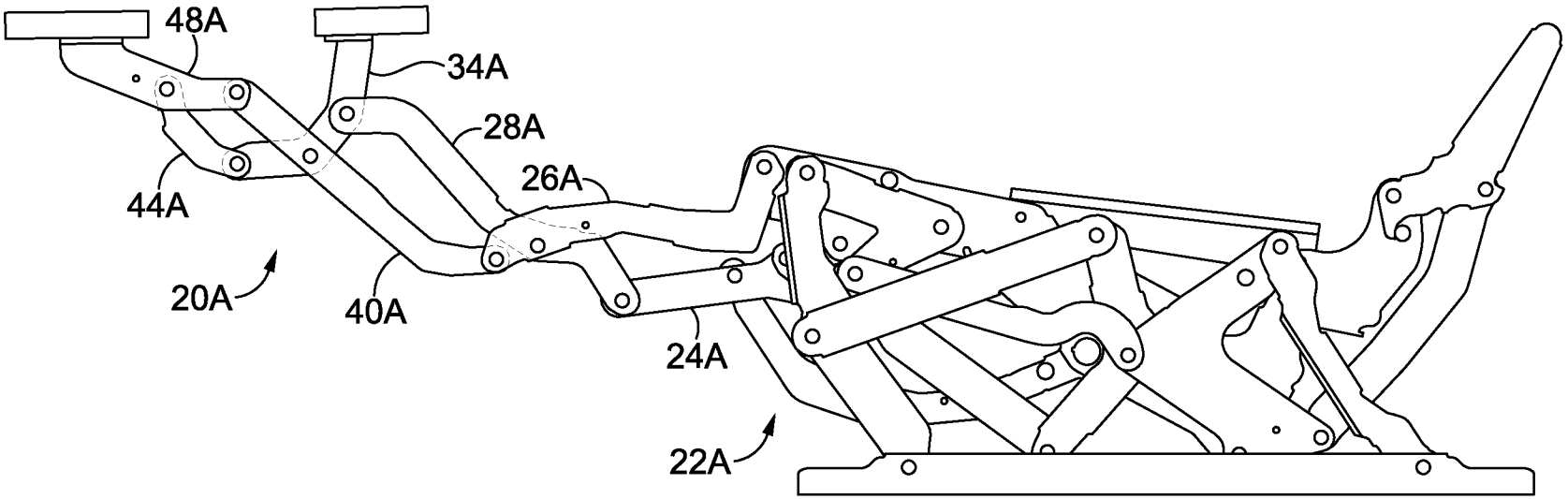
FIG. 9 is a view similar to FIG. 8 with the seat and chaise pad removed.
Figure 10:
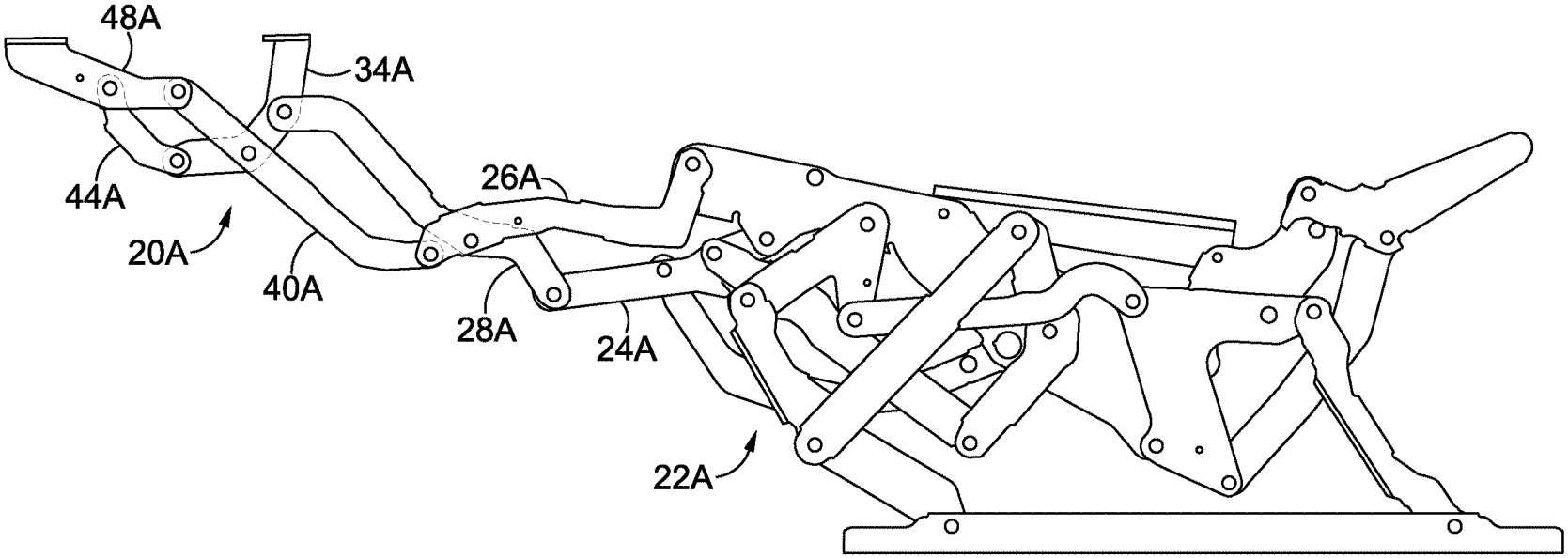
FIG. 10 is a view similar to FIG. 9, showing the fully reclined position without the seat and chaise pad.

FIGS. 6-10 illustrate the reclining mechanism 22A and the ottoman linkage 20A in each of the positions described above with reference to FIGS. 2-5. Particularly, FIG. 6 depicts a chair in an upright position having ottoman linkage 20A coupled to low profile reclining mechanism 22A, and showing the position of a chaise pad 60A and a middle ottoman pad 68A. FIG. 7 depicts the chair as in FIG. 6 but without chaise pad 60A and middle ottoman pad 68A. The ottoman linkage 20A in FIGS. 6 and 7 are in the closed position. FIGS. 8 and 9 depict ottoman linkage 20A in an extended position while reclining mechanism 22A is in a reclined TV position. FIG. 8 also shows the position of chaise pad 60A and middle ottoman pad 68A. FIG. 10 depicts ottoman linkage 20A in an extended position while reclining mechanism 22A is in a fully reclined position. It should be understood that the schematic views depicted in FIGS. 6 and 8 have various chair parts removed and/or have other parts superimposed on other elements in order to highlight relevant features of split ottoman linkage 20A and reclining mechanism 22A.

It is understood and appreciated that the above description of the ottoman linkage 20 with respect to FIGS. 2-5 may also apply to the ottoman linkage 20A depicted in FIGS. 6-10. For example, the above description of how various links of ottoman linkage 20 shift relative to one another to extend ottoman linkage 20 also can apply to ottoman linkage 20A depicted in FIGS. 6-10.

From the foregoing, it will be seen that the disclosed reclining mechanism is well adapted to attain all the ends and objects hereinabove set forth together with other advantages, which are obvious and inherent to the structure.

It will be understood that certain features and subcombinations are of utility and may be employed without reference to other features and subcombinations. This is contemplated by and is within the scope of the claims.

Since many possible alternative reclining mechanisms may be made without departing from the scope thereof, it is to be understood that all matter herein set forth or shown in the accompanying drawings is to be interpreted as illustrative and not in a limiting sense.

What is claimed is:

1. A split ottoman linkage for a reclining chair mechanism on a chair having a frame, a seat, and a backrest, comprising:

a front ottoman link having first and second ends, the first end being coupled to an upper ottoman link of a reclining chair mechanism;

a middle ottoman link having first and second ends, the first end being coupled to a lower ottoman link of the reclining chair mechanism, the middle ottoman link being coupled to the upper ottoman link near the first end;

a bridge link coupled to the second end of the middle ottoman link and to the front ottoman link at a bridge link connection point that is closer to the second end of the front ottoman link than the first end of the front ottoman link, the middle ottoman link and bridge link adapted to extend the bridge link in a relatively constant radial arc;

a front ottoman bracket coupled to the second end of the front ottoman link; and a coupling link pivotably coupled to the bridge link and to the front ottoman bracket;

wherein the split ottoman linkage is adapted to move between a closed position with the bridge link and the front ottoman bracket positioned close to one another, and an extended position where the bridge link and the front ottoman bracket are spaced from one another, and wherein the front ottoman bracket comprises a front ottoman pad attachment platform, wherein the bridge link comprises a chaise pad attachment platform, wherein, when the split ottoman linkage is in the closed position, the chaise pad attachment platform and the front ottoman pad attachment platform are in substantially the same vertical plane, with the chaise pad attachment platform positioned above the front ottoman pad attachment platform.

2. The split ottoman linkage according to claim 1, wherein the front ottoman bracket comprises first and second ends, wherein the first end is pivotably coupled to the second end of the front ottoman link, and wherein the second end of the front ottoman bracket comprises the front ottoman pad attachment platform that is adapted to support a front ottoman pad.

3. The split ottoman linkage according to claim 1, wherein the chaise pad attachment platform is positioned at an end of the bridge link, the chaise pad attachment platform adapted to support a pad of a chair.

4. The split ottoman linkage according to claim 3, wherein the pad of the chair comprises a chaise pad.

5. The split ottoman linkage according to claim 3, wherein the front ottoman pad attachment platform is adapted to support a front ottoman pad, the front ottoman pad being distinct from the pad of the chair.

6. The split ottoman linkage according to claim 1, wherein the chaise pad attachment platform is positioned at an end of the bridge link, the chaise pad attachment platform adapted to support a chaise pad of a chair, wherein the front ottoman pad an attachment platform is adapted to support a front ottoman pad, and wherein, when the split ottoman linkage is in the extended position, the bridge link and the front ottoman bracket are spaced from one another to provide a separation between the pad of the chair and the front ottoman pad.

7. The split ottoman linkage according to claim 6, wherein, when the split ottoman linkage is in the extended position, the separation between the pad of the chair and the front ottoman pad is at least 2.5 inches.

8. The split ottoman linkage according to claim 6, wherein, when the split ottoman linkage is in the closed position, the pad of the chair and the front ottoman pad are adjacent to one another.

9. The split ottoman linkage according to claim 1, wherein the bridge link is coupled near the second end of the front ottoman link at the bridge link connection point, wherein the front ottoman bracket is coupled to the second end of the front ottoman link at a front ottoman bracket connection point, wherein when the split ottoman linkage is shifted between the closed position and the extended position, the bridge link connection point maintains a fixed position along the bridge link and the front ottoman bracket connection point maintains a fixed position along the front ottoman bracket.

10. A split ottoman linkage for a reclining chair mechanism on a chair having a frame, a seat and a backrest, comprising:

a front ottoman link having first and second ends, the first end being coupled to an upper ottoman link of a reclining chair mechanism;

a middle ottoman link having first and second ends, the first end being coupled to a lower ottoman link of the reclining chair mechanism, the middle ottoman link being coupled to the upper ottoman link at an upper ottoman link connection point that is closer to the first end than the second end of the middle ottoman link;

a bridge link coupled to the second end of the middle ottoman link, the bridge link being coupled to the front ottoman link at a bridge link connection point that is closer to the second end than the first end of the front ottoman link, the middle ottoman link and the bridge link adapted to extend the bridge link in a relatively constant radial arc when the split ottoman linkage is shifted between a closed position and an extended position;

a front ottoman bracket having first and second ends, the first end being coupled to the second end of the front ottoman link at a front ottoman bracket connection point; and a coupling link pivotably coupled to the bridge link and to the front ottoman bracket, wherein, when the split ottoman linkage is shifted between the closed position and the extended position, the bridge link connection point maintains a fixed position along the bridge link and the front ottoman bracket connection point maintains a fixed position along the front ottoman bracket, wherein the front ottoman bracket comprises a front ottoman pad attachment platform, wherein the bridge link comprises a chaise pad attachment platform, wherein, when the split ottoman linkage is in the closed position, the chaise pad attachment platform and the front ottoman pad attachment platform are in substantially the same vertical plane, with the chaise pad attachment platform positioned above the front ottoman pad attachment platform.

11. The split ottoman linkage according to claim 10, wherein the coupling link is coupled to the bridge link at a coupling link connection point, wherein the bridge link is coupled to the second end of the middle ottoman link at a middle ottoman link connection point, and, wherein, along the bridge link, the bridge link connection point is positioned between the middle ottoman link connection point and the coupling link connection point.

12. The split ottoman linkage according to claim 10, wherein, when the split ottoman linkage is in a closed position, the bridge link and the front ottoman bracket are positioned close to one another, and wherein when the split ottoman linkage is in an extended position, the bridge link and the front ottoman bracket are spaced from one another.

13. The split ottoman linkage according to claim 10, wherein the chaise pad attachment platform is positioned at an end of the bridge link, the chaise pad attachment platform adapted to support a chaise pad of the chair, and wherein the front ottoman pad attachment platform is adapted to support a front ottoman pad, the front ottoman pad being distinct from the pad of the chair.

14. The split ottoman linkage according to claim 13, wherein, when the split ottoman linkage is in the extended position, the bridge link and the front ottoman bracket are spaced from one another to provide a separation between the pad of the chair and the front ottoman pad, and wherein, when the split ottoman linkage is in the closed position, the pad of the chair and the front ottoman pad are adjacent to one another.

15. A chair having a reclining mechanism, the chair comprising:

a frame;

a seat pad;

a seat back; and a split ottoman linkage adapted for use with a reclining mechanism, the split ottoman linkage comprising:

a front ottoman link having first and second ends, the first end being coupled to an upper ottoman link of the reclining chair mechanism;

a middle ottoman link having first and second ends, the first end being coupled to a lower ottoman link of the reclining chair mechanism, the middle ottoman link being coupled to the upper ottoman link near the first end;

a bridge link coupled to the second end of the middle ottoman link and to the front ottoman link at a bridge link connection point that is closer to the second end of the front ottoman link than the first end of the front ottoman link, the middle ottoman link and bridge link adapted to extend the bridge link in a relatively constant radial arc;

a front ottoman bracket coupled to the second end of the front ottoman link; and a coupling link pivotably coupled to the bridge link and to the front ottoman bracket;

wherein the split ottoman linkage is adapted to move between a closed position with the bridge link and the front ottoman bracket positioned close to one another, and an extended position where the bridge link and the front ottoman bracket are spaced from one another, and wherein the front ottoman bracket comprises a front ottoman pad attachment platform, wherein the bridge link comprises a chaise pad attachment platform, wherein, when the split ottoman linkage is in the closed position, the chaise pad attachment platform and the front ottoman pad attachment platform are in substantially the same vertical plane, with the chaise pad attachment platform positioned above the front ottoman pad attachment platform.

16. The chair according to claim 15, wherein the chaise pad attachment platform is positioned at an end of the bridge link, the chaise pad attachment platform adapted to support at least a portion of the seat pad of the chair, the seat pad of the chair comprising a chaise pad.

17. The chair according to claim 16, wherein the front ottoman pad attachment platform is adapted to support a front ottoman pad, the front ottoman pad being distinct from the seat pad of the chair.

18. The chair according to claim 17, wherein, when the split ottoman linkage is in the extended position, the bridge link and the front ottoman bracket are spaced from one another to provide a separation between the seat pad of the chair and the front ottoman pad, and wherein, when the split ottoman linkage is in the closed position, the seat pad of the chair and the front ottoman pad are adjacent to one another.

19. The chair according to claim 15, wherein the bridge link is coupled near the second end of the front ottoman link at the bridge link connection point, wherein the front ottoman bracket is coupled to the second end of the front ottoman link at a front ottoman bracket connection point, wherein when the split ottoman linkage is shifted between the closed position and the extended position, the bridge link connection point maintains a fixed position along the bridge link and the front ottoman bracket connection point maintains a fixed position along the front ottoman bracket.

* * * * *